United States Patent [19]

Furukawa

[11] Patent Number: 4,614,253

[45] Date of Patent: Sep. 30, 1986

[54] MAST CHANNEL MEMBER CONFIGURATION OF FORKLIFT TRUCK

[75] Inventor: Osamu Furukawa, Tokyo, Japan

[73] Assignee: Nissan Motor Co., Ltd., Yokohama City, Japan

[21] Appl. No.: 612,343

[22] Filed: May 21, 1984

[30] Foreign Application Priority Data

May 23, 1983 [JP] Japan ..... 58-91287

[51] Int. Cl.[4] ..... B66F 9/08

[52] U.S. Cl. ..... 187/9 E; 52/122.1

[58] Field of Search ..... 187/9 E, 9 R, 1 R; 52/122.1, 123.1, 111; 414/631-636

[56] References Cited

U.S. PATENT DOCUMENTS 4,392,554 7/1983 Russey ..... 187/9 E

FOREIGN PATENT DOCUMENTS 2049952 5/1971 Fed. Rep. of Germany ..... 187/9 E 56-103595 8/1981 Japan .

56-128394 9/1981 Japan .

58-31145 2/1983 Japan .

*Primary Examiner*—Joseph J. Rolla

*Assistant Examiner*—Nils E. Pedersen

*Attorney, Agent, or Firm*—Schwartz, Jeffery, Schwaab, Mack, Blumenthal & Evans

[57] ABSTRACT

A mast structure of a forklift truck is composed of two vertically and parallelly extending channel members each of which has front and rear flanges. The thickness of the rear flange is so larger than that of the front flange that a ratio ($e_1/e_2$) of a front-side figure center distance ($e_1$) between a front-most end of the channel member and a center of figure in cross-section to a rear-side figure center distance ($e_2$) between a rear-most face of the channel member and the center of figure is within a range of $1.1 \leqq e_1/e_2 \leqq 1.5$, thereby effectively improving flexural and torsional rigidities of the mast channel member of the forklift truck.

4 Claims, 7 Drawing Figures

MAST CHANNEL MEMBER CONFIGURATION OF FORKLIFT TRUCK

BACKGROUND OF THE INVENTION

1. Field of the Invention

This invention relates to a mast elongating member configuration for a forklift truck, and more particularly to a cross-sectional configuration of a first outer-mast elongating or channel member along which a second inner-mast elongating member is guided to be raised and lowered.

2. Description of the Prior Art

In connection with forklift trucks of the type wherein outer-mast elongating or channel members are provided for guiding inner-mast elongate members to be raised or lowered, each first outer-mast channel member is usually formed generally U-shaped in cross-section. The thicknesses of two flanges of the first member are equal to each other. With such an outer-mast channel member configuration, the flexural rigidity of the first channel member in the forward and backward directions can be maintained; however, the tortional rigidity of the first member is relatively low. This causes shaking of a cargo when the forklift truck turns when the cargo is raised to a high position. This also lowers the loading efficiency and steerability of the forklift truck.

SUMMARY OF THE INVENTION

The mast channel member of a forklift truck of the present invention is composed of front and rear flanges integral with a web, the front flange being located forward the rear flange relative to the forklift truck. The front and rear flanges are respectively formed with front and rear faces which are respectively located fore-most and rear-most in the mast channel member relative to the forklift truck. The thickness of the rear flange is larger that of the front flange so that a ratio ($e_1/e_2$) of a front-side figure center distance ($e_1$) between the front face and a center of the figure in cross-section to a rear-side figure center distance ($e_2$) between the rear face and the center of the figure is within a range of $1.1 \leqq e_1/e_2 \leqq 1.5$. Accordingly, the first outer-mast channel member can be effectively improved in flexural and torsional rigidities compared with conventional channel members without weight increase.

BRIEF DESCRIPTION OF THE DRAWINGS

The features and advantages of the outer-mast channel member of the present invention will be more clearly appreciated from the following description taken in conjunction with the accompanying drawings in which like reference numerals designate the corresponding parts and elements, in which.

DETAILED DESCRIPTION OF THE INVENTION

Figure 1:
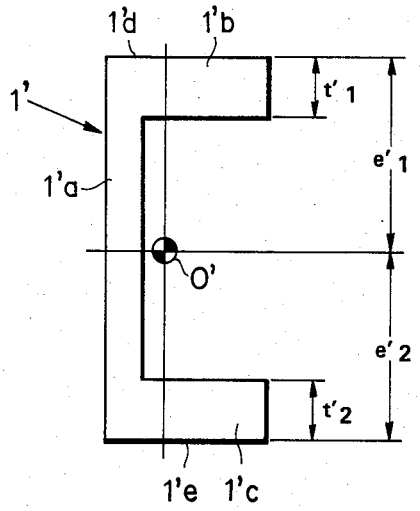
FIG.1 (PRIOR ART)
FIG. 1 is a schematic sectional view of a conventional outer-mast channel member configuration.

To facilitate understanding the present invention, a brief reference will be made to a conventional outer-mast channel member 1' of a forklift truck (not shown), depicted in FIG. 1. In FIG. 1, the outer-mast channel member 1' is formed generally U-shaped and has front and rear flanges 1'b, 1'c which are integral with a web 1'a. The front flange 1'b is located forward the rear flange 1'c relative to the forklift truck. The thickness $t'_1$ of the front flange 1'b is equal to that $t'_2$ of the rear flange 1'c. Therefore, the distance $e'_1$ between the front face 1'd of the channel member and the center of the figure (the center of gravity) O' in cross-section is equal to the distance $e'_2$ between the rear face 1'e of the channel member 1' and the center of the figure. The front and rear end faces 1'd, 1'e are formed on the front and rear flanges 1'b, 1'c and located fore-most and rear-most in the channel member relative to the forklift, respectively. It will be understood that the distances $e'_1$, $e'_2$ are in a cross-section to which a longitudinal axis of the channel member 1' is perpendicular. In such a conventional outer-mast channel member configuration, the distance between the front and rear flanges 1'b, 1'c is usually enlarged so as to obtain an increased section modulus, thereby securing a necessary flexural rigidity in the forward and backward directions.

However, with the above-mentioned conventional outer-mast channel member configuration, although the necessary flexural rigidity can be attained in the forward and backward directions of the outer-mast channel member, its torsional rigidity is unavoidably sharply lowered. As a r sult, drawbacks are encountered in the outer-mast channel member such as shaking of a cargo when the forklift truck turns and the cargo is lifted to a high position. This makes the loading operation difficult while deteriorating the steerability of the forklift truck. In order to overcome these drawbacks, it would be necessary to greatly increase the thickness of whole the channel member to improve the torsional rigidity thereof. However, this increases the weight of the whole outer-mast of the forklift truck, and therefore not only raises the production cost but also deteriorates loading performance. Making the forklift truck larger decreases the turning performance at a smaller turning radius.

Figure 2:
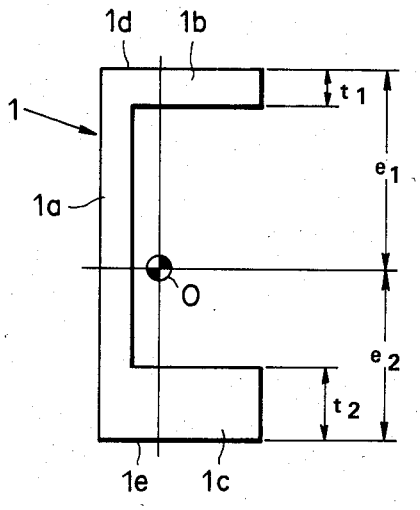
FIG. 2 is a schematic sectional view of an outer-mast channel member of a forklift truck, according to the present invention.

In view of the above description of the conventional outer-mast channel member configuration, reference is now made to FIG. 2 wherein an embodiment of the outer-mast channel member of a forklift truck (not shown) of the present invention is illustrated by the reference numeral 1. The channel member 1 is formed generally U-shaped and has front and rear flanges 1b, 1c which are integral with a web 1a. The front flange 1b is located forward the rear flange 1c relative to the forklift truck, i.e., relative to the straight ahead direction of the forklift truck. In this embodiment, the thickness $t_2$ of the rear flange 1c is larger than the thickness $t_1$ of the front flange 1b. The ratio (figure center distance ratio) $e_1/e_2$ of the distance (figure center distance) $e_1$ between the front face 1d of the channel member 1 and the center of figure (the center of gravity) 0 in cross-section to the distance (figure center distance) $e_2$ between the rear face 1*e* of the channel member 1 and the figure center 0 is within a range of $1.1 \leqq e_1/e_2 \leqq 1.5$. The front and rear faces 1*d*, 1*e* are formed on the front and rear flanges 1*b*, 1*c* and located fore-most and rear-most in the channel member relative to the straight-ahead direction of the forklift truck. Accordingly, the channel member front and rear faces 1*d*, 1*e* correspond to the outer surfaces of the front and rear flanges 1*b*, 1*c*, respectively. It will be appreciated that the distances $e_1$, $e_2$ are in a cross-section of the channel member 1 to which a longitudinal axis (not shown) of the channel member is perpendicular.

Significant advantages gained by the abovementioned range of $1.1 \leqq e_1/e_2 \leqq 1.5$ will be hereinafter discussed with reference to FIGS. 3, 4 and 5 and using a channel member having the following dimensions: the length ($l_0$) of the channel member in the forward and backward direction (web width) is 200 mm; the width ($b_0$) is 70 mm; the web thickness ($t_0$) is 20 mm, and the sum ($t_1+t_2$) of the front flange thickness $t_1$ and the rear range thickness $t_2$ is 60 mm.

Figure 3:
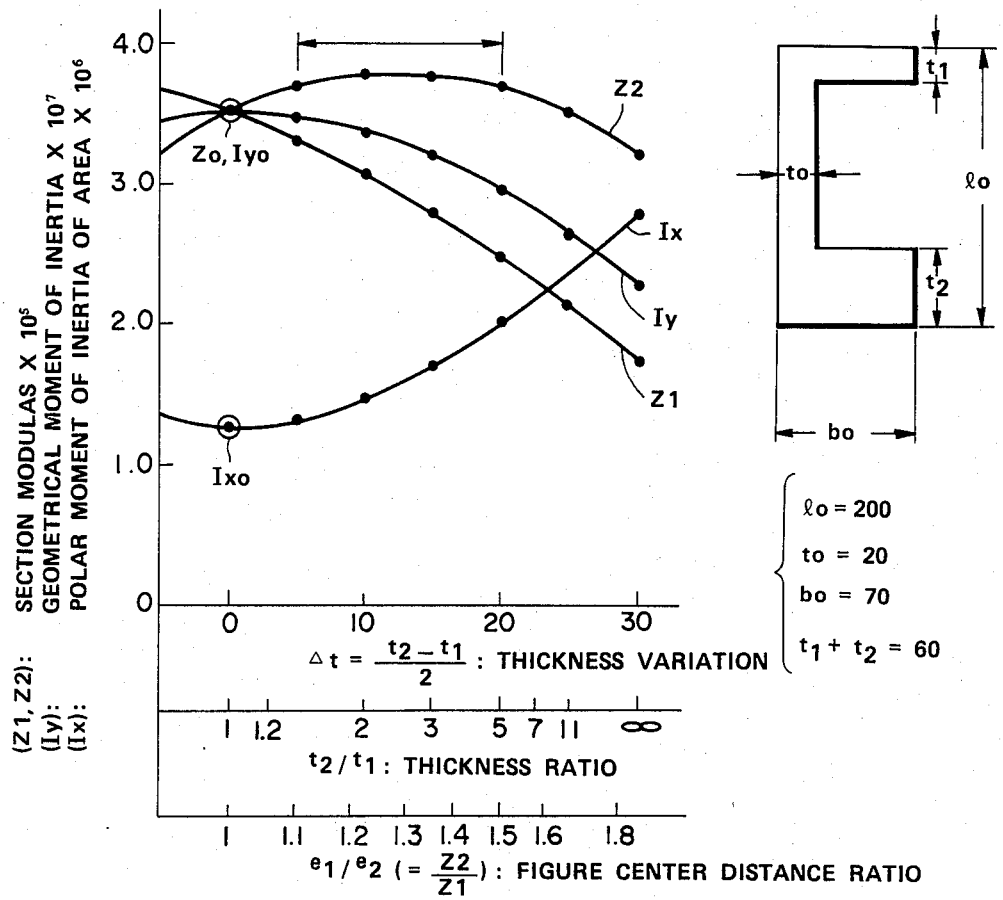
FIG. 3 is a graph showing the variation of section constants of the outer-mast channel member with with changing figure center distance ratios.

First, in case where the cross-sectional area and the above-mentioned fundamental cross-sectional dimensions ($l_0$, $b_0$ and $t_0$) are set constant; the geometrical moment of inertia $I_y$ relative to an axis parallel with the front and rear flanges 1*b*, 1*c* of the channel member (i.e., in the forward and backward bending direction), section moduli $Z_1$, $Z_2$ in the range from the center of figure 0 to the front and rear flange outer surfaces 1*d*, 1*e*, and polar moment of inertia of area $I_x$ of the channel member 1 were determined and represented with respect to thickness variation $\Delta t(=(t_2-t_1)/2)$, the thickness ratio $t_2/t_1$, and the figure center distance ratio $e_1/e_2$ to obtain a graph of FIG. 3. Similarly, in FIG. 4, the percentages of the abovementioned section constants $I_y$, $I_x$, $Z_1$ and $Z_2$ of the channel member shown in FIGS. 2 and 3 relative to the corresponding section constants $I_{y0}$, $I_{x0}$, and $Z_0$ of outer-mast channel member 1' shown in FIG. 1 are determined and represented with respect to the thickness variation $\Delta t$, the thickness ratio $t_2/t_2$, and the figure center distance ratio $e_1/e_2$.

Figure 4:
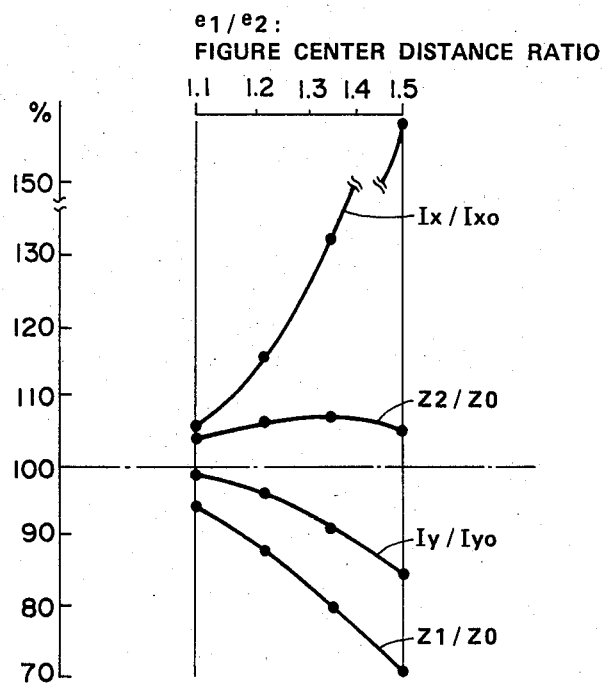
FIG. 4 is a graph showing the ratio of the section constants of the channel member of the present invention to those of the conventional channel member.

As follows, a comparison made between the outer-mast channel members of the present invention and the conventional channel member with reference to FIGS. 3 and 4 yields the following results:

(1) The geometrical moment of inertia $I_y$ and the section modulus $Z_1$ of the channel member of the present invention is less than that of the conventional member, so that the rigidity ratio $I_y/I_{y0}$ in the forward and backward bending direction lowers 16% and the strength ratio $Z_1/Z_0$ lowers 30% if the figure distance ratio exceeds 1.5 as shown in FIG. 4.

(2) The polar moment of inertia of area $I_x$ of the channel member of the present invention is similar to that of the conventional member if the figure center distance ratio $e_1/e_2$ is smaller than 1.1, but very excellent compared with the conventional one if the ratio $e_1/e_2$ is within a range of $1.1 \leqq e_1/e_2 \leqq 1.5$ so that the torsional rigidity ratio $I_x/I_{x0}$ is improved 5–57% as shown in FIG. 4.

(3) The section modulus $Z_2$ of the channel member of the present invention is most excellent as compared with that of the conventional member if the ratio is within a range between 1.2 to 1.3, but similar to that of the conventional member and further lowers if the ratio $e_1/e_2$ exceeds 1.6. The strength ratio $Z_2/Z_0$ is improved 4–7% if the ratio $e_1/e_2$ is within the range of $1.1 \leqq e_1/e_2 \leqq 1.5$ as shown in FIG. 4.

Figure 5:
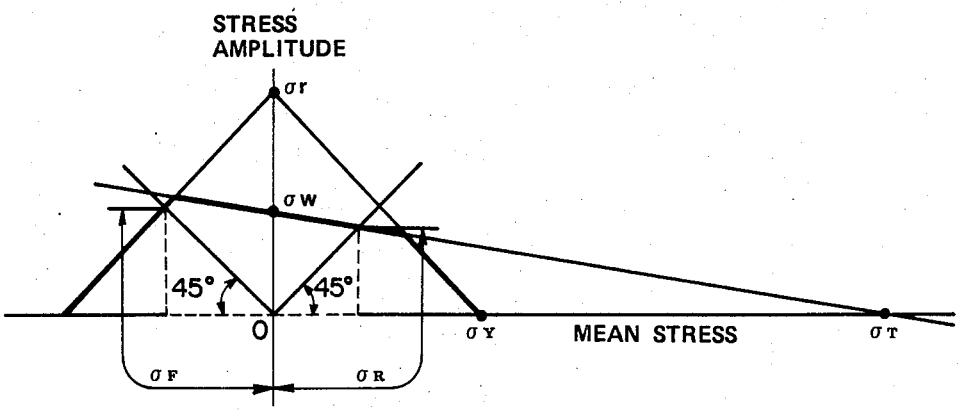
FIG. 5 is a graph showing a fatigue yield limit curve of an outer-mast channel member.

FIG. 5 shows a fatigue yield limit graph in which the notch factor or stress concentration factor is 1, and stress concentration due to welding and the like is ignored. This graph depicts the stress amplitude relative to the mean stress. In the graph of FIG. 5, $\alpha_Y$ indicates yield stress, $\alpha_T$ true rupture stress, $\alpha_W$ alternation limit (fatigue limit upon deflection in opposite directions), $\alpha_F$ fatigue yield limit of the front flange (upon deflection in one direction), $\alpha_R$ fatigue yield limit of the rear flange (upon deflection in one direction). This graph reveals the fact that the strength is afforded for the outer-mast channel member if the respective stress valves are within a range inside the heavy line, in which the following approximate relationship is established:

$$\alpha_T \approx 3\alpha_Y,$$

and $$\alpha_Y \approx 2\alpha_W$$

from FIG. 5, the following is obtained:

$$\alpha_F \approx \alpha_Y,$$

and $$\alpha_R \approx 6/7\alpha_Y$$

Accordingly, the fatigue yield stress ratio $\alpha_F/\alpha_R$ becomes $7/6 \approx 1.17$. This shows the fact that even if the section modulus $Z_1$ of the front flange is set smaller than the modulus $Z_2$ of the rear flange in case stress concentration is ignored, the same degree of safety as in the rear flange can be attained in the front flange. In this connection, it will be understood from FIG. 5 that it is possible to increase the stress applied to the front flange up to 17%.

In general, there is scarcely a case where welding is made to the front flange except for a rare example where a carriage stopper is welded to the front flange. On the contrary, a mast support member, a reinforcement beam, and the like are welded to the rear flange, and therefore the safety of stress concentration due to the above-mentioned welding must be taken into consideration. This means that there is no problem theoritically and practically even if the section modulus of the front flange is decreased by an amount corresponding to the notch factor due to stress concentration.

In this connection, lowering the section modulus $Z_1$ of the front flange causes a lower geometrical moment of inertia $I_y$ and finally leads to lowering in flexural rigidity in the forward and backward directions. Consequently, the rigidity ratio $I_y/I_{y0}$ of 20% or less can be determined as an approximate standard. This value of 20% has been determined because of the fact that location and angle correction of the outer-mast channel member is possible in the forward and backward directions since the forklift is provided with a tilt cylinder for tilting the mast structure. This rigidity ratio value is practically negligible as compared with the deflection of the outer-mast channel member due to the deflection of front wheels of the forklift truck.

In view of the above, it will be appreciated that the figure center distance ratio $e_1/e_2$ within the range of $1.1 \leqq e_1/e_2 \leqq 1.5$ is optimum. Such an $e_1/e_2$ greatly improves the polar moment of inertia of area $I_x$ contributing to the torsional rigidity by selecting the most effective section modulus $Z_2$ of the rear flange without lowering the section modulus $Z_1$ of the front flange to such an extent as not to be negligible as the geometrical moment of inertia.

With the thus arranged outer-mast channel member, the thickness of the rear flange is enlarged as compared with that of the front flange thereby to improve section modulus $Z_2$ of the rear flange. This configuration greatly improves the torsional rigidity (polar moment of inertia of area $I_x$) as compared with the conventional outer-mast channel member. This configuration also secures the flexural rigidity of the channel member in the forward and backward directions. The flexural rigidity effectively suppresses the shaking of a cargo due to the torsion of the mast channel member even when the forklift truck turns under a condition where the cargo is lifted at a high position. Therefore, loading operation efficiency is greatly improved while maintaining good steerability of the forklift truck.

Additionally, since the front flange is formed smaller in thickness than the rear flange, it has been possible to reduce the distance of the outer-mast channel member in the forward and backward direction (the width of the web). This solves particularly such a problem heretofore encountered in production of a conventional outer-mast channel member having a larger web width that a production facility for the mast channel unavoidably becomes large-sized.

The width of the web of the outer-mast channel member of a forklift truck of 5–6 ton capacity type is necessarily larger than that of 1–4 ton capacity truck type. It will be understood that, in case of production of the channel member by a hot extruding method, an extrusion production facility of the size depending upon the web width is necessary. Accordingly, the above-mentioned web width reduction makes it possible to produce the mast channel member for the 5–6 ton capacity type forklift using the production facility for the 1–4 ton type forklift truck, thus affording the advantage that smaller-size production facility is sufficient to produce the mast channel member for use in a larger-size forklift truck having a high loading capacity. Furthermore, it will be appreciated that the center of gravity of the mast channel member is positioned backward as compared with the conventional member, thereby improving stability of the forklift truck in the forward and backward direction.

Figure 6:
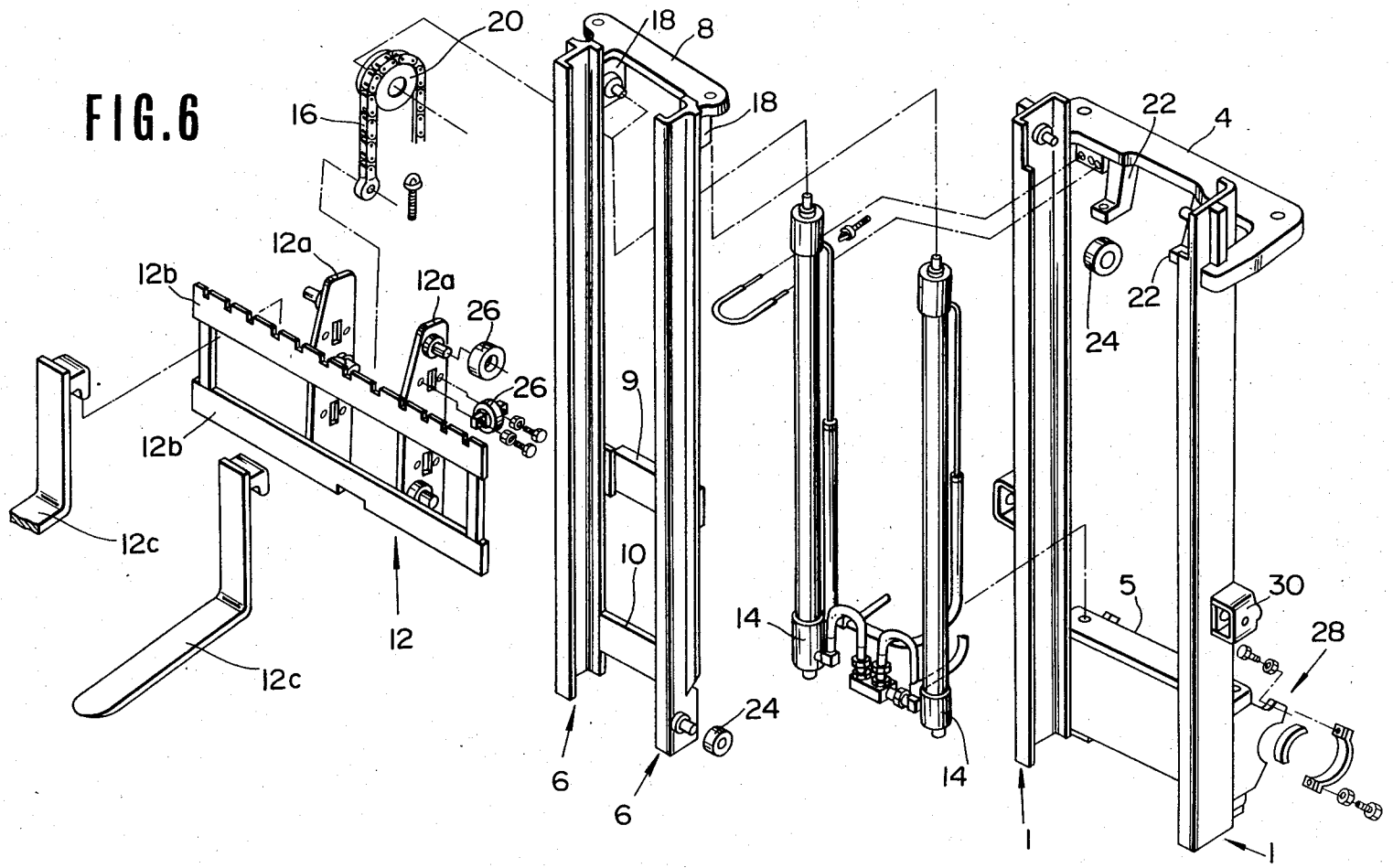
FIG. 6 is a perspective view of a loading device of a forklift truck incorporating the present invention.
Figure 7:
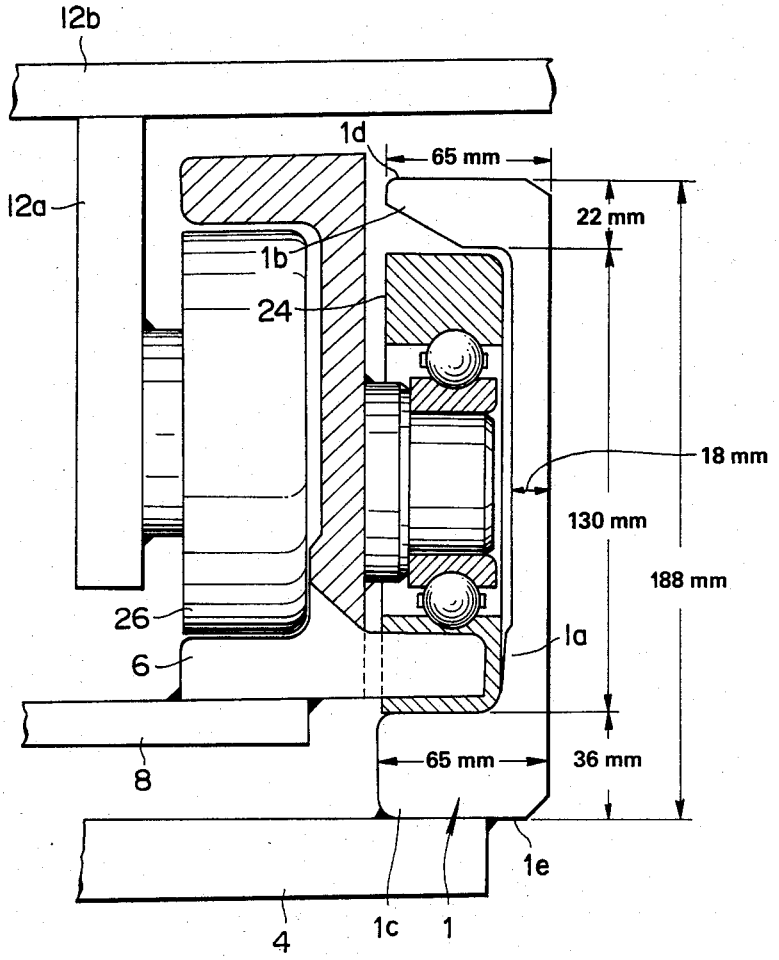
FIG. 7 is a plan view, partly in section, of an essential part of the loading device of FIG. 6.

Next, a loading device of a forklift truck to which the present invention is applied will be explained with reference to FIGS. 6 and 7.

The loading device of the forklift truck comprises two parallelly and vertically extending outer-mast channel members 1 which are connected at their upper end sections with each other by means of a welded upper beam 4, and at their lower end sections with each other by means of a welded lower beam 5, thereby forming an outer-mast structure (no numeral). Each outer-mast channel member 1 has such a dimension that the thickness of a web 1*a* is 18 mm; the thickness of a front flange 1*b* is 22 mm; the thickness of a rear flange 1*c* is 36 mm; the width of the web 1*a* is 188 mm; and the width of the front and rear flanges 1*b*, 1*c* is 65 mm.

Two vertically and parallelly extending inner-mast elongate or channel members 6 are connected at their upper, middle and lower sections with each other, thereby forming an inner-mast structure (no numeral). A carriage 12 includes two vertically and parallelly disposed lift-brackets 12*a* which are provided at their front faces with two finger-bars 12*b* extending horizontally and parallelly. Additionally, two fork tines 12*c* are installed on the finger-bar 12*b* in a hanging manner.

Two lift-cylinders 14 are provided to function to raise and lower the inner-mast members 6. A lift-chain 16 is engagingly disposed on a sprocket 20 which is rotatably attached to the upper end section of each inner-mast member 6 through a sprocket bracket 18. The lift-chain 16 is connected at its one end to a chain anchor bracket 22 which is secured at its one end with the outer-mast upper beam 4. The other end of the lift-chain 16 is secured to the lift-bracket 12*a*.

Lift-rollers 24 are rotatably attached on the inner surface of the upper end section of the outer-mast channel member 1 and the outer surface of the lower end section of the inner-mast member 6, respectively. These lift-rollers 24 function to vertically and slidably guide the inner-mast members 6 along the outer-mast channel members 1 during the ascending and descending operation of the inner-mast structure relative to the outer-mast structure. Lift-rollers 26 are rotatably attached on the outer surface of each lift-bracket 12*a* and located at the upper, middle and lower sections of the lift-bracket 12*a*. The lift-rollers 26 function to guide the carriage 12 along the inner-mast members 6 during the ascending and descending operation of the carriage 12 relative to the inner-mast structure. A mast-support 28 is welded to the rear face of the lower end section of each outer-mast channel member 1 and arranged to support the outer-mast channel members 1 in a manner to be capable of tilting forward and backward the outer-mast channel members 1, 1 relative to a body (not shown) of the forklift truck. A tilt-cylinder backet 30 is welded to the outer surface of the middle section of each outer-mast channel member 1, and connected to a tilt-cylinder (not shown) for tilting forward and backward the outer-mast structure.

In operation, when the piston rods of the lift-cylinders 14, 14 are extended after a cargo is loaded on the fork tines 12*c*, 12*c*, the inner-mast elongating members 6 are raised along the outer-mast channel members 1. In accordance with this action of the inner-mast members 6, the carriage 12 is raised along the inner-mast members 6 under the action of the chain 16. On the contrary, when the piston rods of the lift-cylinders 14 are contracted, the carriage 12 is lowered.

What is claimed is:

1. A mast channel member of a forklift truck, comprising:

a member consisting of a substantially planar web; and first and second flanges integral with said web, said first flange being located forward said second flange relative to the forklift truck, said first and second flanges respectively having first and second faces which are respectively located fore-most and rear-most in said mask channel member relative to the forklift truck; and wherein a thickness of said second flange is larger than a thickness of said first flange such that a ratio ($e_1/e_2$) of a first distance ($e_1$) between the first face and a center of gravity of the figure in cross-section, to a second distance ($e_2$) between the second face and the center of gravity is within a range of $1.1 \leqq e_1/e_2 \leqq 1.5$.

2. A mast channel member as claimed in claim 1, wherein said ratio ($e_1/e_2$) is within a range of $1.2 \leqq e_1/e_2 \leqq 1.3$.

3. A mast channel member as claimed in claim 1, wherein said channel member forms part of an outer-mast structure along which an inner-mast structure provided with fork tines is slidably guided.

4. A forklift truck comprising:

an inner-mast structure including first and second straight extending members which movably supports a carriage having fork tines; and an outer-mast structure including first and second straight extending channel members along which said inner-mast first and second members are guided, respectively;

each of said outer-mast structure first and second channel members having a member consisting of a substantially planar web, and first and second flanges integral with said web, said first flange being located forward said second flange relative to the forklift truck, said first and second flanges respectively having first and second faces which are respectively located fore-most and rear-most in said mast channel member relative to the forklift truck; and wherein a thickness of said second flange is larger than a thickness of said first flange such that a ratio ($e_1/e_2$) of a first distance ($e_1$) between the first face and a center of gravity of the figure in cross-section, to a second distance ($e_2$) between the second face and the center of figure is within a range of $1.1 \leqq e_1/e_2 \leqq 1.5$.

* * * * *